US006090032A

United States Patent [19]

Bellanca

[11] Patent Number: 6,090,032

[45] Date of Patent: Jul. 18, 2000

[54] APPARATUS FOR FOLDING PAPER

[75] Inventor: Joseph V. Bellanca, Sarasota, Fla.

[73] Assignee: Joseph V. Bellanca Revocable Trust, Sarasota, Fla.

[21] Appl. No.: 09/272,856

[22] Filed: Mar. 19, 1999

[51] Int. Cl.[7] ..... B31F 1/00

[52] U.S. Cl. ..... 493/423; 493/441; 493/448; 493/966; 493/941

[58] Field of Search ..... 493/441, 423, 493/448, 966, 941, 426, 431, 436, 415, 424, 440, 439

[56] References Cited

U.S. PATENT DOCUMENTS

| | | | |
|---|---|---|---|
| 3,973,770 | 8/1976 | Montenbruck | 271/272 |
| 4,310,326 | 1/1982 | Bellanca | 493/423 |
| 5,655,866 | 8/1997 | Bellanca | 412/1 |

*Primary Examiner*—Peter Vo
*Assistant Examiner*—Eric Weierstall
*Attorney, Agent, or Firm*—Charles J. Prescott

[57] ABSTRACT

An apparatus for sequentially forming folds in a sheet of paper which is continuously moving substantially in a single plane. A first fold is formed in the center of the continuously-moving sheet of paper and subsequent pairs of folds are sequentially formed, one on each side of the previously-formed folds, until the entire continuously-moving sheet is folded. Guide wires retain each folded section until the entire sheet is folded by the cyclic upward movement of a continuous flexible wire loop held for free movement on a pair of spaced apart pulley assemblies. Each pulley assembly includes a plurality of evenly spaced pulleys each of which are held for free rotation on a support frame. Each support frame is driven in rotation about a central axis of rotation. Each individual pulley includes a freely rotatable ring surrounding the periphery of the pulley around which the flexible wire loop is held.

7 Claims, 9 Drawing Sheets

APPARATUS FOR FOLDING PAPER

BACKGROUND OF THE INVENTION

1. Scope of Invention

This invention relates generally to a method and apparatus for folding a sheet of paper which is continuously moving in a single plane.

2. Prior Art

Heretofore it was necessary to momentarily stop the lateral movement of a sheet of paper in order to form a fold. One common type of folding mechanism is a buckle folder wherein the leading edge of the sheet is fed into a pocket causing the adjacent portion to buckle and to be fed into the bite of adjacent folding rolls. Another type of folder is the blade type when the sheet is passed over a pocket and a blade operates to push a portion of the sheet into the pocket to form a fold. In both prior-known types of folding, the forward or feeding motion of the sheet has to be momentarily stopped while the fold is being formed.

My previous U.S. Pat. No. 4,310,325 provides a method and apparatus for folding a sheet of paper without interrupting the path of movement and the continuous feeding motion of the sheet. This is important to increase the folding speed of the sheets. Each folded portion of the sheet is retained in its folded position while the additional folds are sequentially formed. However, in this previous patent, the speed of this apparatus and method were limited due to the fact that only one sheet would be raised and folded for each revolution of the sheet folding mechanism, it having a pair of spaced apart single excentrically mounted pulleys. Based in part upon other significant improvements by applicant in signature folding sequencing as taught in another of my previous U.S. Pat. No. 5,655,866, a substantially higher sheet folding rate is now a desired feature not offered by current technology.

BRIEF SUMMARY OF THE INVENTION

An apparatus for sequentially forming folds in a sheet of paper which is continuously moving substantially in a single plane. A first fold is formed in the center of the continuously-moving sheet of paper and subsequent pairs of folds are sequentially formed, one on each side of the previously-formed folds, until the entire continuously-moving sheet is folded. Guide wires retain each folded section until the entire sheet is folded by the cyclic upward movement of a continuous flexible wire loop held for free movement on a pair of spaced apart pulley assemblies. Each pulley assembly includes a plurality of evenly spaced pulleys each of which are held for free rotation on a rotatable support frame. Each support frame is driven in rotation about a central axis thereof. Each individual pulley includes a freely rotatable ring surrounding the periphery of the pulley around which the flexible wire loop is held.

One object of this invention is to form folds in a sheet of paper at higher fold rates while the sheet is moving in a predetermined path.

Another object is to sequentially form folds in a sheet of paper which is moving in a predetermined path.

Another object of this invention is to sequentially form folds in a sheet of paper which is continuously moving in a predetermined path at higher rates of speed and wherein the folded portions are retained in folded position until the entire sheet is folded.

A still further object of this invention is to accurately fold a sheet of paper into sections at a higher rate of speed.

In accordance with these and other objects which will become apparent hereinafter, the instant invention will now be described with reference to the accompanying drawings.

BRIEF DESCRIPTION OF THE DRAWINGS

FIG. 1 is a schematic drawing showing the sequential folding of a sheet at four operating stations.

FIG. 2 is a fragmentary top plan view of the folding apparatus taken on lines 2—2 of FIG. 3.

FIG. 3 is a cross-sectional view of the sheet-folding mechanism taken on line 3—3 of FIG. 4.

FIG. 4 is an end-elevational view showing Station I in solid lines which is fully illustrated in FIG. 3, and Stations II and III in dotted lines.

FIG. 5 is an enlarged cross-sectional view taken on line 5—5 of FIG. 3 showing the folded portion of the sheet of paper as it leaves Station I and being retained by guides 36, 37 and fold guide 39.

FIG. 6 is an enlarged fragmentary section of folding mechanism pulley and fold wire.

FIG. 7 is an enlarged cross-section showing the interrelationship between the folding wire, the folded portion of sheet and the folding rollers.

DETAILED DESCRIPTION OF THE INVENTION

Related Prior Art

Figure 1:
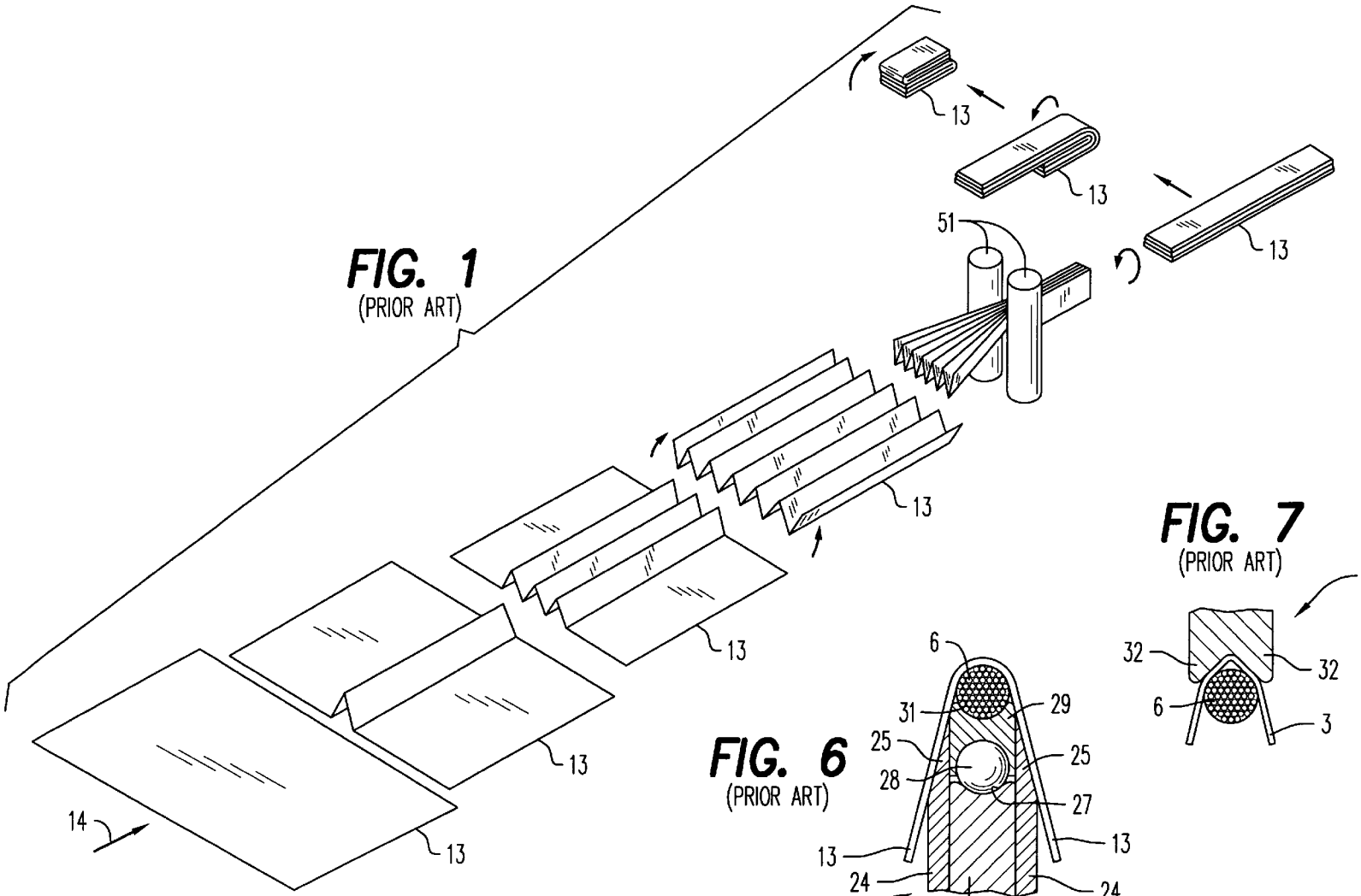
FIG. 1 (PRIOR ART)
FIGS. 1 to 7 are taken from my prior U.S. Pat. No. 4,310,326.

Referring now to the drawings, FIGS. 1 to 7 describe my closely related prior U.S. Pat. No. 4,310,326. FIG. 1 therein shows a schematic drawing of the folding operations performed on each sheet of paper fed into the folder. As shown, a sheet of paper is fed flat into the folder and while in substantially continuous motion, a first fold is formed in the sheet at station 1. The sheet continues to move and while in motion two more folds are formed, one on each side of the first fold at station II. The sheet continues to move and two more folds are formed, one at each end of the previously formed folds at station III. The completely folded sheet is then laid on its side. At this point, as shown, the folded sheet is subjected at station IV to two more folds which are at right angles to the original folds.

Figure 3:
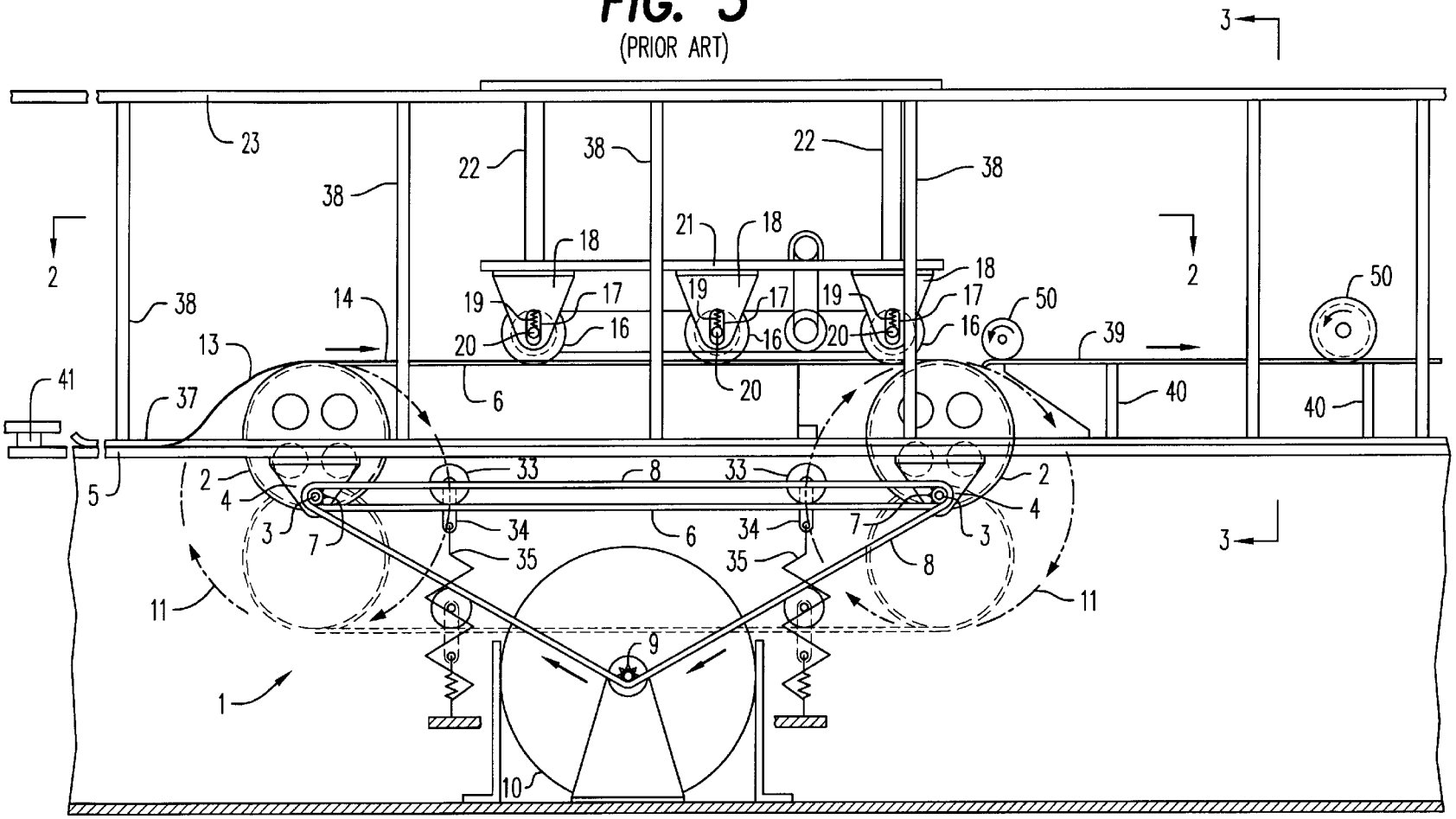
FIG. 3 (PRIOR ART)

FIG. 3 shows a side elevation of the novel sheet-folding mechanism 1. This mechanism 1 comprises a pair of spaced-apart pulleys 2, each of which is eccentrically mounted to its respective shaft 3 which in turn is mounted in its respective support 4 each of which is secured to the undersurface of the table surface 5. A continuous braided wire 6 tightly extends around and between both pulleys 2. A sprocket 7 is secured to each pulley shaft 3 and a timing belt 8 extends over each sprocket 7 and over a sprocket 9 connected to the drive shaft of a motor 10 mounted to the base of the machine. The sheet-folding mechanism 1, comprising the pulleys 2 and the wire 6, is driven in an elliptical path 11 (shown in dotted lines) by the motor 10.

An opening 12 is formed in the table surface 5 having a width and length sufficient to permit the passage and the movement of the folding mechanism 1. In operation, the wire 6 contacts the sheet 13 and pulls it upwardly with its movement. Thus the length of the fold formed in the sheet of paper is equal to the distance that the folding mechanism travels above the table surface 5. It should be understood that the folding mechanism 1 may be adjustably mounted to the undersurface of the table surface 5 so that the distance that it moves above the surface of the table surface 5 can be adjusted to form the desired length of the fold to be formed in the sheet.

As shown in FIG. 3, a paper-ejecting mechanism comprises a plurality of driven rollers 16 and an axle 20 for each roller is mounted in a slot 17 formed in a yoke 18 for each roller. A spring 19 is mounted in each slot 17 to retain the axle 20 of each roller 16 under pressure at the bottom of each slot 17. The yokes 18 are secured to a frame 21 which is secured to upwardly-extending supports 22. The upper end of supports 22 are adjustably secured to the upper machine frame 23. The rollers 16 are positioned so that they will contact the wire 6 when the folding mechanism 1 is at the uppermost reach of its elliptical path.

Figure 6:
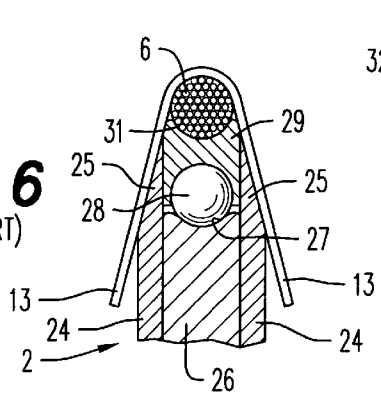
FIG. 6 (PRIOR ART)

FIG. 6 is an enlarged, fragmentary, cross-sectional view showing the detailed construction of a pulley 2 and a roller 16 and the interaction of the pulley 2, the wire 6, the folded paper 13 and the roller 16 at the time that the folding mechanism is at the uppermost reach of its elliptical movement. As shown, each pulley 2 is constructed of a pair of outer discs 24 with the outer surfaces of the peripheral edge having an inwardly-tapered surface 25 extending to a point. The inner core 26 of the pulley has a diameter smaller than the diameter of the discs 24. The outer edge of the pulley core 26 has a roller bearing raceway 27 for receiving a plurality of roller bearings 28. An outer ring 29 having a roller bearing raceway 30 in its inner surface is positioned to contact the roller bearing 28 and extends slightly beyond the periphery of the disc members 25. The outer surface of ring 29 has a concave surface 32 for receiving the braided wire 6. Thus it can be seen that the wire 6 has a rotational movement about the pulleys 2 independent of and in addition to the elliptical movement that it has as it is carried along with the movement of the eccentrically mounted pulleys 2.

Figure 7:
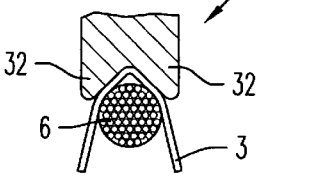
FIG. 7 (PRIOR ART)

As further shown in FIG. 7, each of the driven rollers 16 are formed having their outer periphery formed into outwardly extending legs 32. It is to be understood that FIG. 7 shows the parts enlarged with the pulley 2 at the uppermost reach of its eccentric movement and the wire 6 in contact with the spring-loaded roller 16 which is rotated at a high speed. At this point, the folding mechanism 1 is at its highest point of elliptical movement and the wire 6 has contacted and lifted a portion of sheet 13 away from table 2. Since the high-speed roller 16 is spring loaded, the net effect is to slightly lift the sheet from the wire 6 and to form a slight crease.

Referring to FIG. 3, the solid lines show the folding mechanism at the uppermost reach of its elliptical path. Since the rollers 16 confine the paper between the peripheral surfaces 32 of the rollers 16 and the wire 6 and since the rollers 16 are spring loaded, a downward pressure is applied to the upper reach of wire 6. To assure that the upper reach of wire 6 remains tight, it is desirable to place a wire-tensioning means on the lower reach of the wire 6. This tensioning means takes the form of a pair of grooved pulleys 33 freely rotatably mounted in the upper end of yokes 34. A spring member 35 is secured at one end to the lower end of each yoke 34 and fixed at its lower end to the base of the machine. Thus, as shown in FIG. 3, the solid lines show the springs 35 under maximum tension, and thus exerting maximum tension of wire 6, when the folding mechanism is in the uppermost reach of its elliptical path and under minimum tension when the folding mechanism 1 is at the lowermost reach of its elliptical path as shown in the dotted lines.

It is important to retain the portion of the sheet which is not subject to the folding action of the folding mechanism in the plane of the table surface 5. This is accomplished by providing guide rods 36 and 37, one on each side of slot 12 in the table surface 5. These guide rods 36 and 37 are retained in a position slightly above table surface 5 a distance sufficient to allow free passage of the sheet by means of vertical supports 38 which are adjustably secured at their upper ends to the upper machine frame 23. As the wire 6 of the fold mechanism 1 contacts the sheet 13 and moves the contacted portion of the sheet upward, each side of the sheet is pulled around the guide rods 36 and 37 and the remaining portion of the sheet. As shown in FIG. 3, a fold guide 39 is positioned at the forward end of the table surface opening 12 and is retained at the same distance above the table 5 as the upward movement of the folding mechanism 1 by supports 40 which are in turn secured to the top of table 5. The guide rods 36 and 37 and fold guide 39 extend the length of the fold machine to control the sheet at the top and bottom of each fold.

As seen in FIG. 3, each sheet 13 is fed onto the table 5 in the direction shown by arrow 14 by dogs 41 which contact the rear edge of the sheet 13. The dogs 41 are secured to a conventional chain drive which extends beneath and at each side of the table surface 5 to a point approximately at the forward end of opening 12. Dogs 41 are spaced on the chain drive at a distance greater than the width of each sheet so that the sheets are fed onto table 5 and into the folding mechanism 1 one after the other.

FIG. 3 illustrates the folding mechanism and operation that takes place at station 1. A sheet 13 is fed onto the table and as it passes through opening 12 the folding mechanism moves in its elliptical path and wire 6 contacts the sheet and raises it and at the same time pulls the sheet around guide rods 36 and 37. As the folding mechanism 1 reaches the uppermost limit of its elliptical path, a portion of the paper which is folded over wire 6 contacts the rollers 16 which are rotating rapidly at about 2,000–3,000 revolutions per minute and the entire sheet 13 is rapidly driven forward and the upper folded portion is driven onto fold guide 39. The forward movement of the sheet 13 is so rapid that the contact of the sheet between rollers 16 and wire 6 and the driving of the upper fold portion of tile sheet onto the fold guide 39 takes place during the small period of time that the folding mechanism 1 is at its uppermost reach in its elliptical path. The elliptical movement of the folding mechanism 1 and the movement of the sheet-feed dogs 41 are coordinated so that, as each succeeding sheet 13 is fed onto the table surface 5 and over opening 12, the folding mechanism 1 is again starting its upward movement through opening 12.

Figure 2:
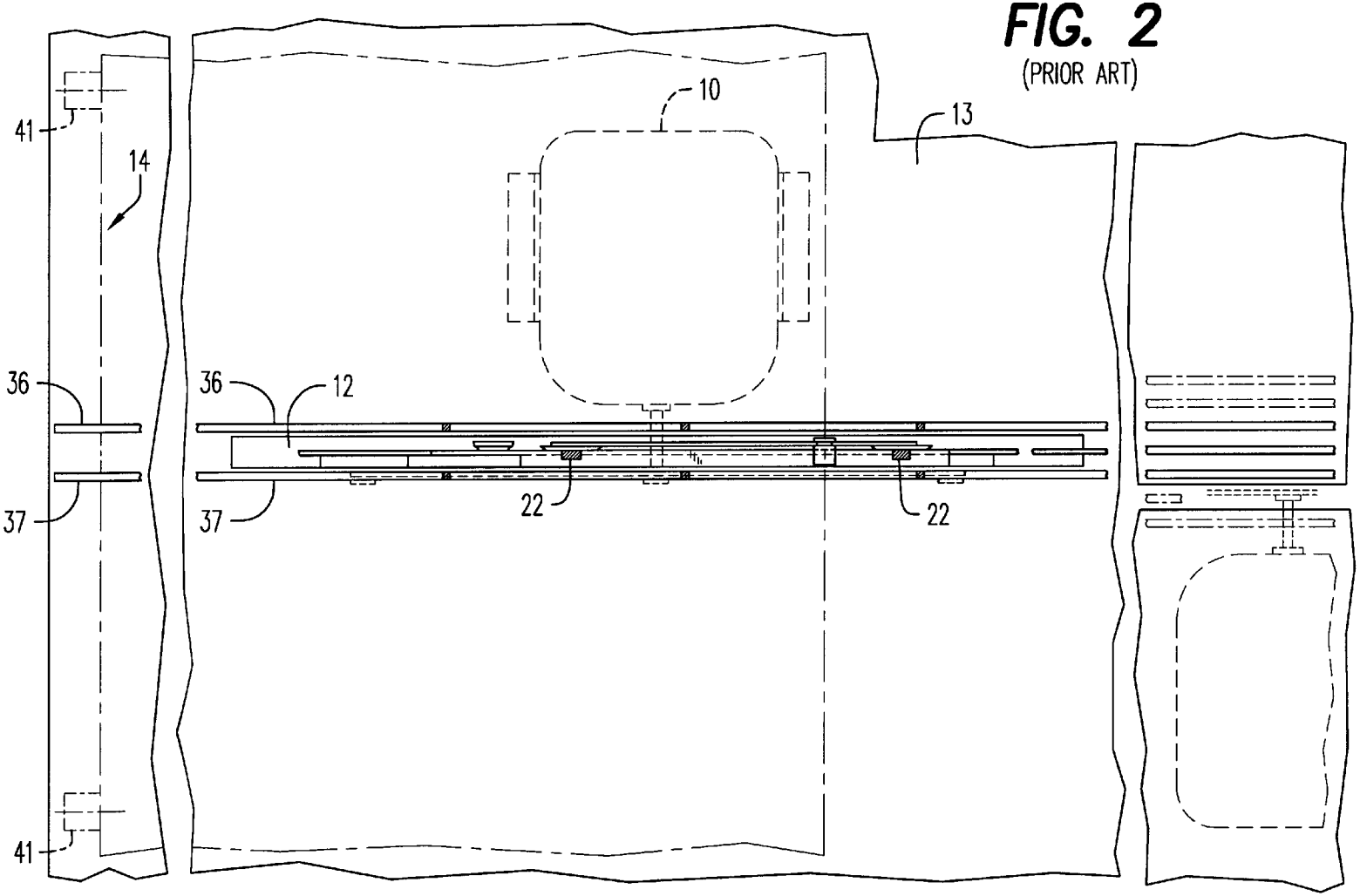
FIG. 2 (PRIOR ART)
Figure 4:
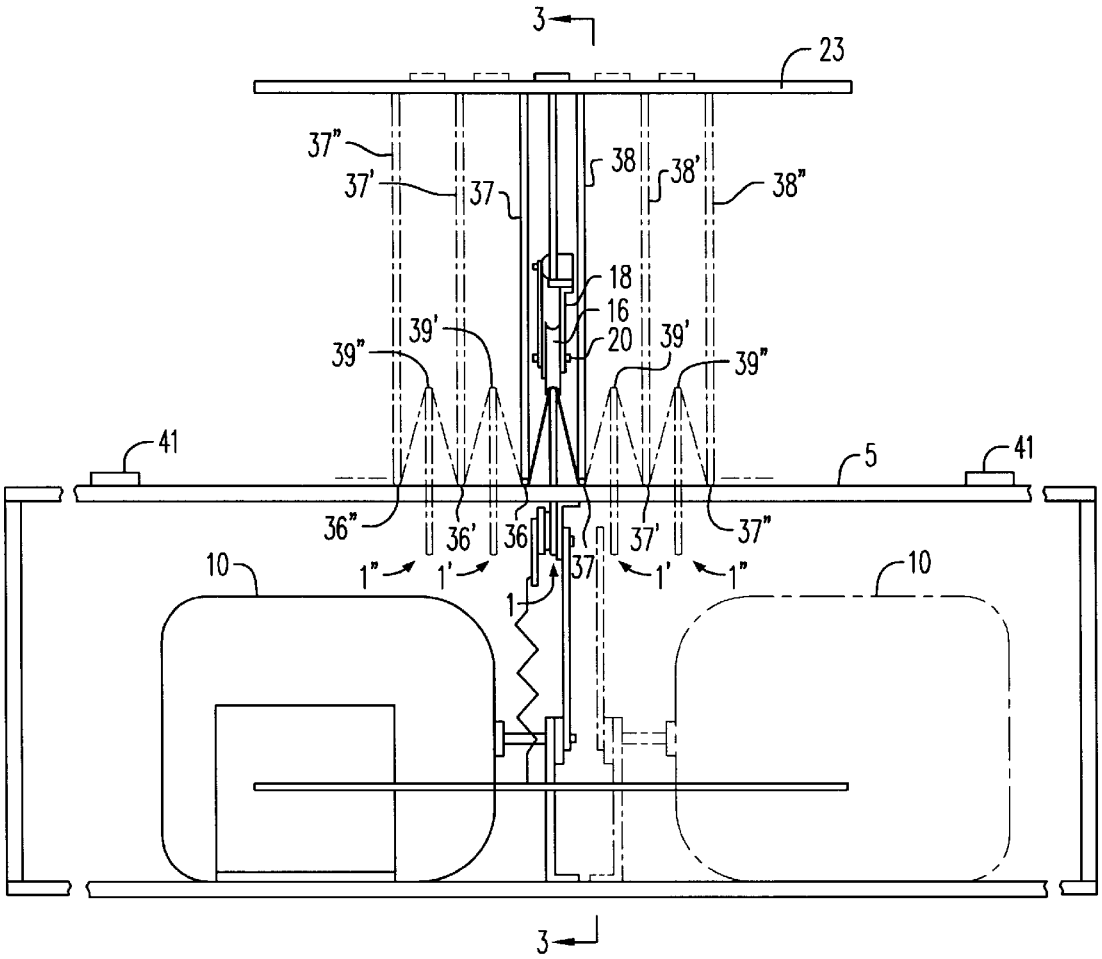
FIG. 4 (PRIOR ART)
Figure 5:
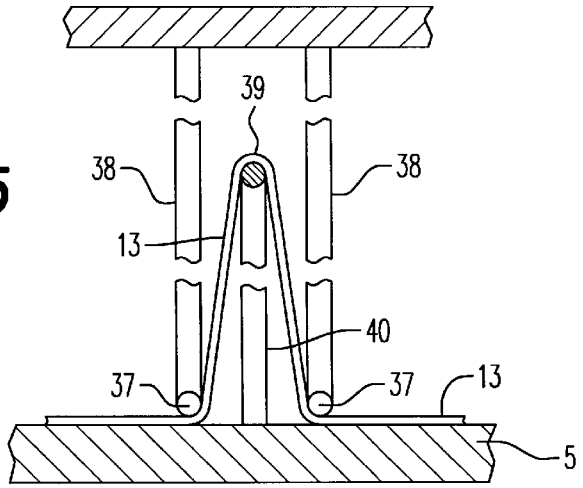
FIG. 5 (PRIOR ART)

Station II is located adjacent to Station I and comprises two folding mechanisms 1' which are identical to folding mechanism 1 and which are located one on each side of guide rods 36 and 37 and fold guide 39 as best seen in FIGS. 2 and 4. Each of these folding mechanisms 1 has additional guide rods 36' and 37' to complement guide rods 36 and 37 but which start at Station II and extend to the end of the machine. Each folding mechanism 1' also has its own fold guide 39' which, like fold guide 39 at Station I, is positioned at the end of table opening 12 and extends from that point to the end of the machine. The folding mechanisms 1' operate in tandem in the same manner as the folding mechanism 1 at Station I.

As the sheet 13 is fed from Station II and into Station III, it now has three upwardly extending folds. Station III comprises two folding mechanisms 1' which are identical to folding mechanism 1 and which are located one on each side of guide rods 36" and 37" to complement guide rods 36' and 37' but which start at Station III and extend to the end of the machine. Each folding mechanism 1" has its own fold guide 39" which, like fold guides 39 and 39', is positioned at the end of its table opening 12 and extends from that point to the end of the machine. Throughout its passage through the folder, the folds in the sheet 13 are maintained by the guide rods 36, 37, 36', 37', 36", and 37" and by the fold guides 39, 39' and 39". As the folded sheet is fed from Station III it is fed off the guide rods and fold guides and between a pair of conventional vertically-extending rollers 51 as seen in FIG. 1 which compress the folds further and allow the folded sheet to lie flat on the table surface after turning. At that point the folded sheet can be removed or, if desired, the same folding mechanism can be used to fold the folded sheet at right angles to the original folds at a Station IV.

It is to be understood that the guide rods 36 and 37 and fold guide 39 at each station can be adjusted for various paper thicknesses and widths of folds. The speed of elliptical movement of the folding mechanism 1 and the rotational speed of cooperating rollers 16 can be adjusted for the type and weight of paper being folded. It may also be desirable, under some operating conditions, to provide added feeding rollers 50 which cooperate with the fold guide 39 to assist in moving each sheet 13 from one station to the next. Other adjustments of parts and speeds of operation may be made to accommodate the type of material being folded without departing from the spirit and scope of the invention. Additionally, at the end of Station III, sheet metal elements may be provided at each side of the folding mechanism to guide the leading edge of the folded sheet into the rollers 51. After the folded sheet has been folded at Station IV glue may be applied to one folded edge for perfect binding. If desired, a plurality of sheets 13 which have been folded at Station IV may be grouped together and glue applied to one edge for perfect binding. It has been found that, when the disclosed folding method is utilized and the folded sheets perfect bound, a paper saving of as much as 8 percent can be achieved.

The Invention

Referring now to the drawings, FIGS. 8 to 12, the improved folding mechanism of the present invention is shown generally at numeral 60 in all figures. This improved folding mechanism 60 includes a pair of spaced apart pulley assemblies 62, each of which is mounted centrally thereof to each respective mounting shaft 66 and 68 via a triangular frame 82 of each of the pulley assemblies 62. Each respective shaft 66 and 68 is, in turn, connected beneath a table surface 81 previously described in FIGS. 3 and 4.

A continuous braided wire 74 tightly extends around and between both pulley assemblies 62. A sprocket (not shown) is secured to each shaft 66 and 68 and a timing belt (not shown) extends over each of the sprockets and over another sprocket connected to a drive shaft of a motor (not shown) mounted to the base of the machine as previously described in FIG. 3. Thereby, the sheet folding mechanism 60, comprising the pulley assemblies 62 and the wire 6, is driven by the motor (not shown) as previously described.

Figure 12:
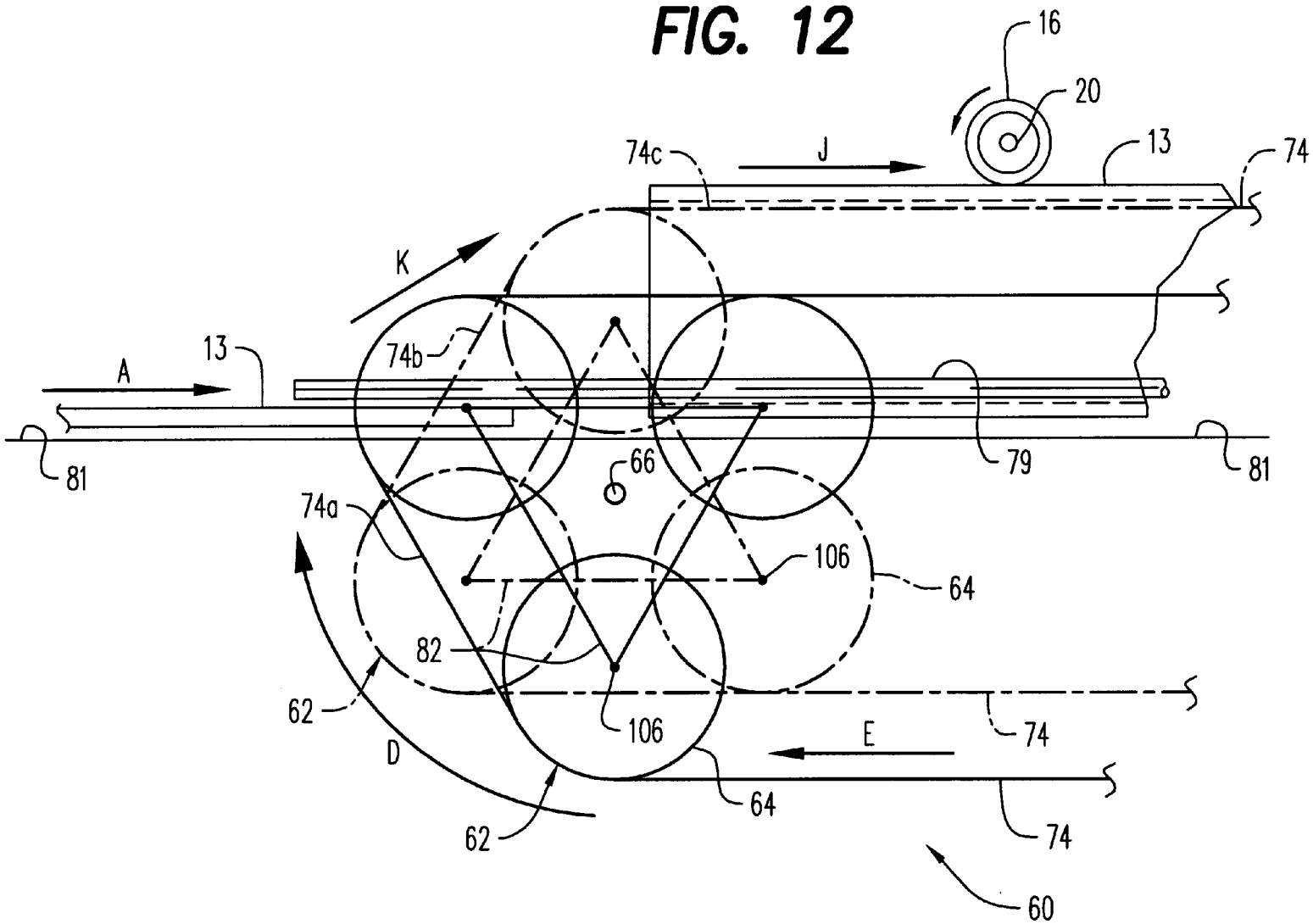
FIG. 12 is a simplified diagrammatic view of one portion of the sheet folding mechanism showing the sequential movement thereof.

An elongated opening similar to that shown at numeral 12 in FIG. 2, is formed in the table surface 81 having a width and length sufficient to permit the passage and the movement of the folding mechanism 60 therethrough. In operation, as previously described, the wire 74 contacts each sheet 13 and pulls or lifts it upwardly with corresponding movement of the wire 74 as best shown in FIG. 12. When each pulley assembly 62 rotates about shaft 66 in the direction of arrow D as each sheet 13 is being fed into the folding mechanism in the direction of arrow A, the wire segment 74*a* shown in solid lines moves toward the position shown in phantom at 74*b*. This wire movement starts the folding process of each sheet 13 as each of the pulley assemblies 62 rotate in unison further into the maximum vertical positioning of the wire at 74*c*.

Thus, the length of the fold formed in the sheet of paper 13 is equal to the distance that the folding mechanism 60 travels above the table surface 81 as previously described. Adjustability is also provided in the vertical positioning of the folding mechanism 60 so as to vary the length to be formed in each sheet 13 again as previously described.

A paper-ejecting mechanism similar to that shown in FIG. 3 comprises a plurality of driven rollers 16 each mounted on a separate axle 20. These rollers 16 are positioned so as to contact the wire 74 when the folding mechanism 60 is at its uppermost reach shown in phantom in FIG. 12. Each of the pulleys 64 is mounted on frame 82 for free rotation about separate shafts 106 and structured in function similar to that shown in FIG. 6. Thus, the outer edge of each of the pulleys 64 are structured as shown at 29 in FIG. 6 to receive the braided wire 74 and to rotate independently with respect to the central main portion of each pulley 64. Referring back to FIG. 7, each of the driven rollers 64 is similarly formed having the outer periphery thereof formed into outwardly extending legs 32 which enhance the folding process of each sheet 13.

To insure that the upper reach of wire 74 remains tight, as previously described, it is desirable to place a wire tensioning means on the lower reach of the wire 74 as shown and described in FIG. 3. It is also important in the present invention to retain a portion of each sheet 13 which is not subject to the folding action of the folding mechanism 60 in the plane of the table surface 81. This is accomplished in a fashion similar to that previously described by providing guide rods 79 one on each side of the folding mechanism clearance slot (not shown) formed into the table surface 81. These guide rods 79 function as previously described in FIGS. 2,3 and 5. The fold guide rod 76 is positioned at the forward end of the table surface 81 and is retained at the same distance above the table surface 81 as is the maximum upward positioning of the wire 74 of the folding mechanism 60 by supports connected to the table surface 81. The fold guides 79 receive the folded sheet of paper ejected by the driven pulleys 16 and may be assisted in moving each folded sheet 13 from one station to the next by feed rollers 50, again as previously described.

Figure 9:
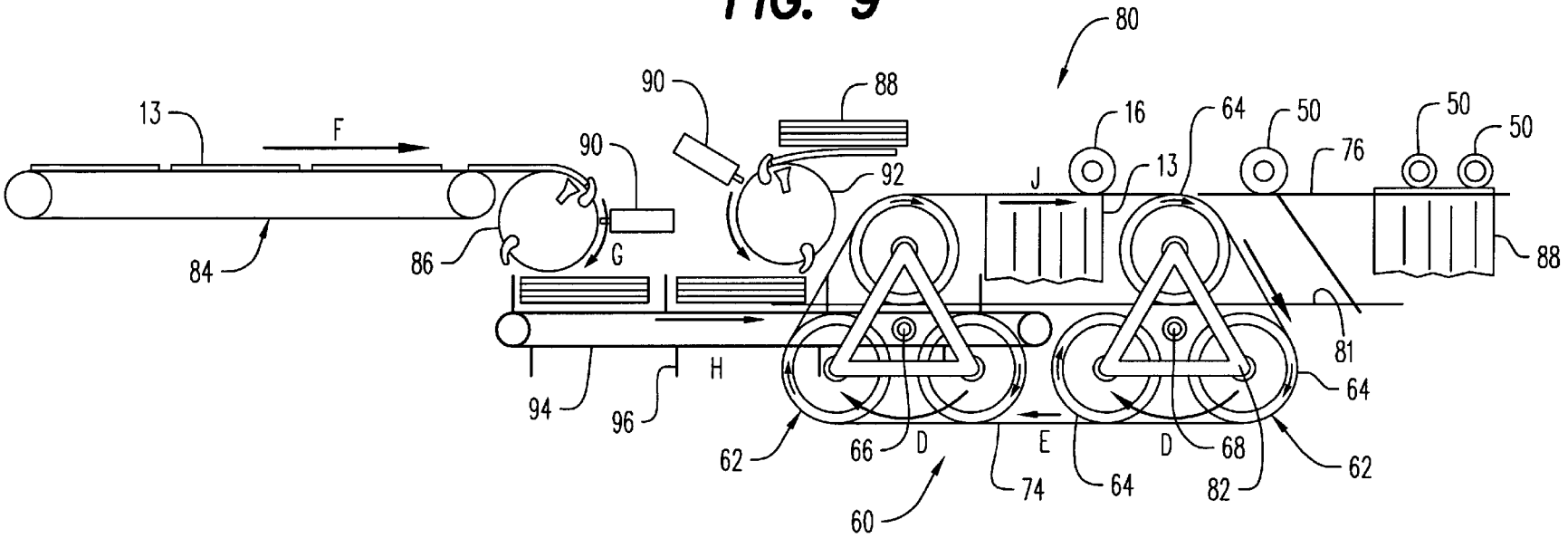
FIG. 9 is a side elevation simplified schematic view of the sheet folding mechanism of the invention within a system for feeding, folding and ejecting sheet signatures and book covers.

Referring to FIG. 9, one embodiment of a signature folding apparatus is there shown generally at numeral 80 and includes the previously described folding mechanism 60. This apparatus 80 includes an endless feed belt 84 which feeds signatures in sequential order without the last fold formed in the direction of arrow F. A stacking drum 86 receives each of the partially folded sheets 13, applies glue at 90 as each of the sheets passes in the direction of arrow G onto one stack thereof. Covers 88 are likewise sequentially stacked by another stacking gum 92 as glue is also applied at 90. As the feed belt 94 with dogs 96 is moved in the direction of arrow A, the respective sequence of partially folded signatures 13 and partially folded covers 88 are fed onto the folding mechanism 60 in the direction of arrow J for the final folding operation.

Figure 10:
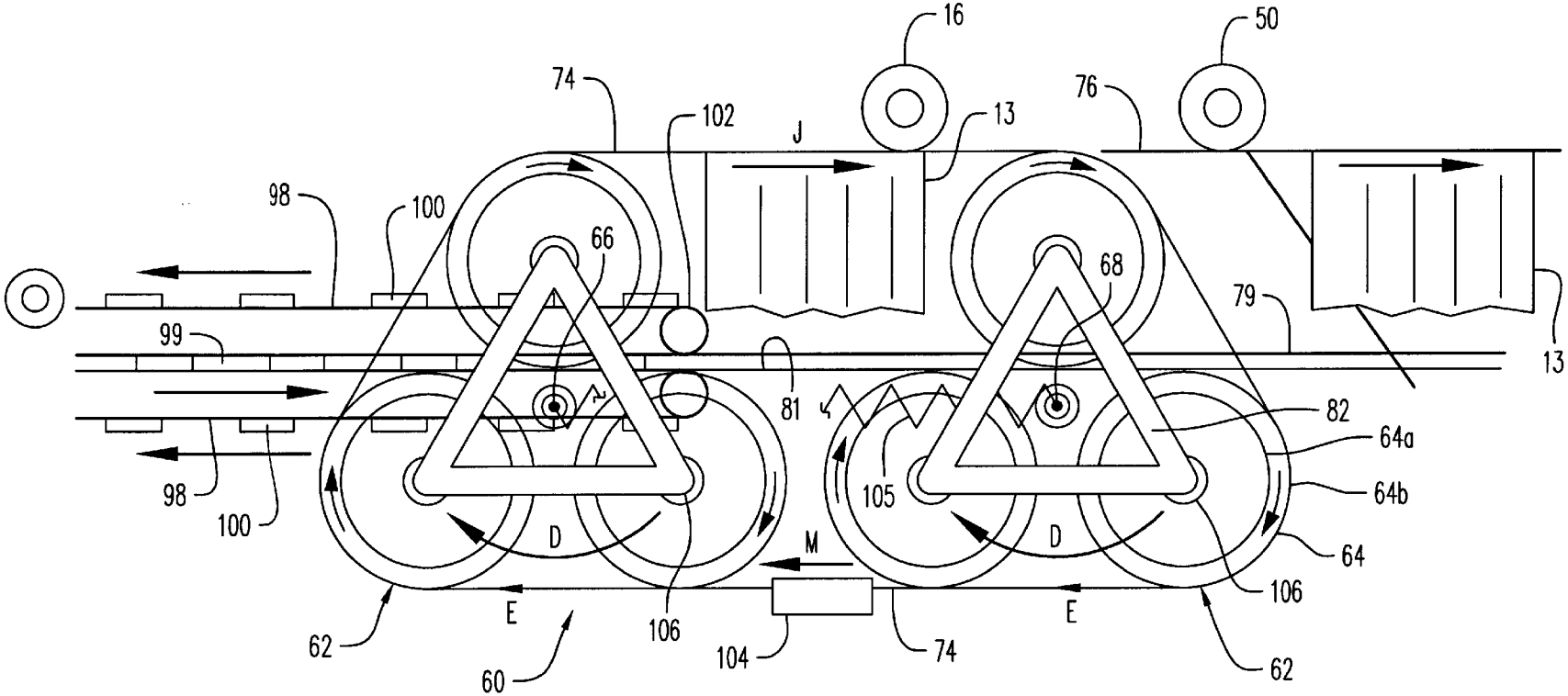
FIG. 10 is an enlarged view of the sheet folding mechanism of FIG. 9 and also showing an alternate and preferred form of a magnetic sheet feeding mechanism.
Figure 11:
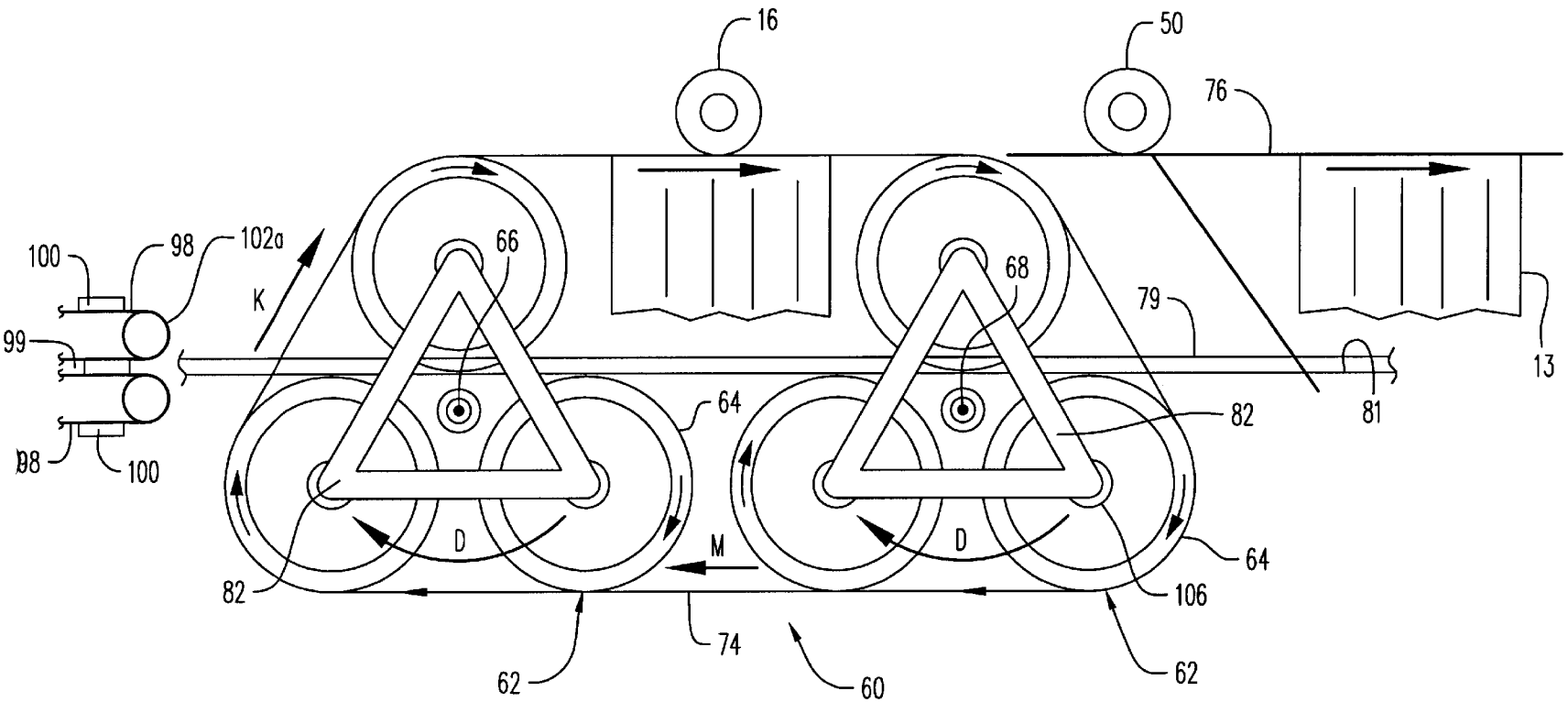
FIG. 11 is a view similar to FIG. 10 showing an alternate terminal position of the sheet feeding mechanism.

Alternate similar sheet feed mechanisms are shown in FIGS. 10 and 11. These sheet feed mechanisms include two opposed continuous belts 98 each of which have spaced apart thin magnets 100 attached thereto. As the magnets 100 are centrally between the two closely spaced feed belts 98 at 99 with each sheet 13 clampingly retained therebetween, sufficient sheet clamping force allows the fold to start to take place on the moving wire 74 of the folding mechanism 60 until the guide rods 79 take over to engage and retain a portion of the sheet to complete fold. In the arrangement of FIG. 10, the feed belts 98 terminate at 102 while overlapping the folding mechanism 60 for insured fold tightness and retention of unfolded portions of each sheet against the table surface 81. In this embodiment, a magnetized wire driving device 104 producing a substantially continuous driving force M on wire 74 (which is made of a magnetic material) is utilized in lieu of the wire driving motor previously described. This wire driving device 104 assists in driving the wire 74, the other driving forces being the rotation of each of the pulley assemblies 62 and rotation of the driven rollers 16 against the wire 74 to eject the folded signatures 13. A compression spring 105 in FIG. 10, or the like, acting against each shaft 66 and 68 is preferred to maintain a separating biasing force between the pulley assemblies 62.

The magnetic feed belts 98 in FIG. 11 are similar to that shown in FIG. 10 except that the end 1 02a of the feed belts 98 terminate short of the folding mechanism 60 wherein the guide rods 79 extend further rearwardly to insure that each sheet 13 is held tightly against the table surface 81 except as controlled by the lifting and folding action of the folding mechanism 60.

Figure 8:
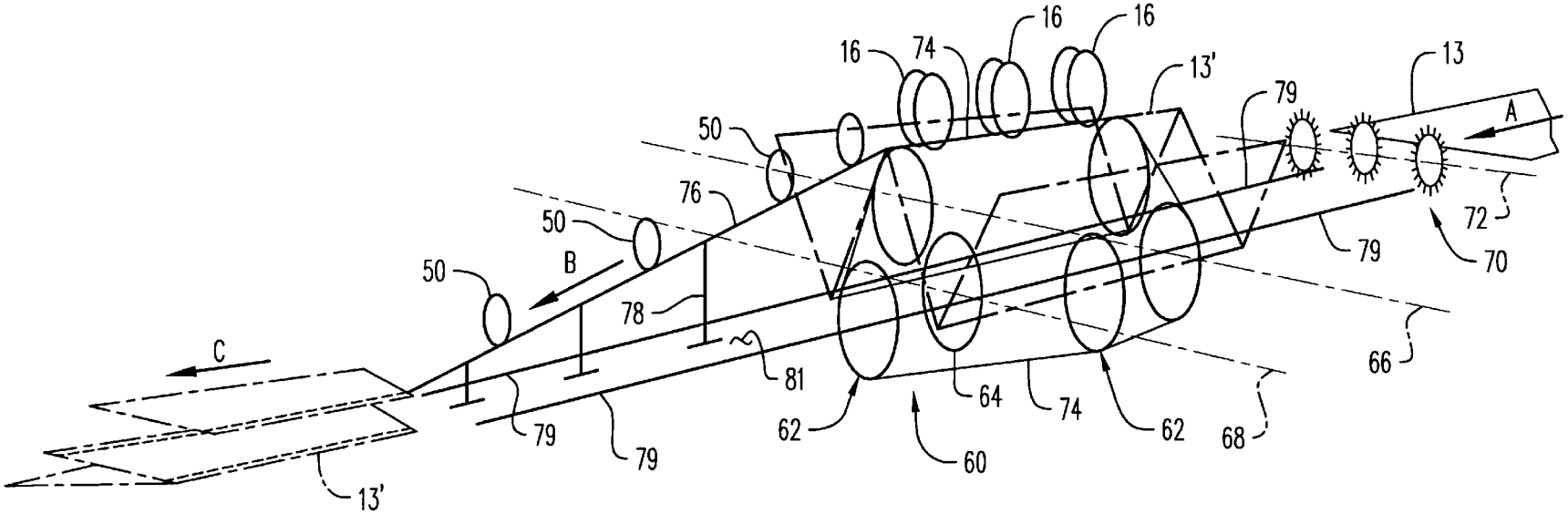
FIG. 8 is a perspective simplified schematic view showing the present invention sequentially folding sheets of paper such as signatures used in book binding.

As shown in FIG. 8, a perforation assembly may be included as shown at numeral 70. The usefulness of perforating these sheets along the intended fold line has been established in another of my co-pending U.S. patent applications which substantially improves the bonding strength of the binding edge of each book. Thus, each sheet 13 moving into the folding mechanism 60 in the direction of arrow A is initially perforated along the intended fold line prior to being sent into and folded by the folding mechanism 60 as previously described.

A primary benefit of the of the present invention over my prior U.S. '326 patent is speed. Whereas my previous folding mechanism 1 provided one fold per revolution of the pulleys 2 about an eccentrically located shaft, the present invention will provide a plurality of folds per each revolution of each of the pulley assemblies 62 of the folding mechanism 60 itself. Although three pulleys 64 per pulley assembly 60 appear to increase folding speed to an ideal fold rate at this time, nonetheless the use of two pulleys, four, five or more may be utilized in each of the pulley assemblies so that a corresponding number of folding movements of the tensioned folding wire achieved for each revolution of each of the pulley assemblies. Although with increasing numbers of pulley wheels per pulley assembly, the upward throw of the folding wire is decreased, it is believed that this may be compensated both by the vertical positioning of the folding mechanism with respect to the table surface 81 and with respect to variations in the paper feed arrangement into the folding mechanism with the addition of slanted guide plates or wires (not shown).

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. An apparatus for folding a sheet of paper comprising;

a table surface for receiving a flat sheet of paper;

means for moving said sheet of paper across said table surface;

an opening in said table surface;

a first paper restraining means spaced above said table surface a distance just sufficient to permit the passage of said sheet between it and said table surface and positioned along each side of said table opening;

second paper restraining means spaced above said table a distance equal to the length of a fold in said sheet of paper positioned at the forward end of and in alignment with the center of said table opening;

two spaced apart pulley support frames each said frame mounted on said apparatus for substantially free rotation about a separate central axis of rotation of each corresponding said frame, said axis being substantially parallel one to another and to, and positioned beneath, said table surface;

a sheet folding mechanism including a closed loop flexible member extending about a pair of spaced apart pulley assemblies each of which includes a plurality of pulleys mounted in evenly spaced fashion one to another for free rotation on each of said support frames;

means for rotatably driving said pulley assemblies about each said central axis of rotation causing the upper reach of said flexible member to rise and fall while remaining substantially parallel to said table surface;

rotatable sheet ejecting means positioned above said sheet folding mechanism contacting said sheet when said flexible member reaches its uppermost movement to drive said sheet onto said second paper restraining means.

2. An apparatus for folding a sheet of paper comprising:

a table surface for receiving a flat sheet of paper;

means for moving said sheet of paper across said table surface;

an elongated opening in said table surface;

a first paper restraining means spaced above said table surface a distance just sufficient to permit the passage of said sheet between it and said table surface and positioned along each side of said table opening;

second paper restraining means spaced above said table a distance equal to the length of a fold in said sheet of paper positioned at the forward end of and in alignment with the center of said table opening;

a sheet folding mechanism including a substantially continuous loop of flexible wire extending about first and second spaced apart pulley assemblies, each of which freely rotate about a first and second central axis upon which a first and second pulley frame are mounted and upon which a plurality of pulleys freely rotate about their separate respective pulley axes which are evenly spaced about their respective central axis of their respective frame;

means for rotatably driving said pulley assemblies about each said axis of rotation causing the upper reach of said flexible member to rise and fall while remaining substantially parallel to the surface of the table;

rotatable sheet ejecting means positioned above said sheet folding mechanism contacting the folded sheet of paper when said flexible member reaches its uppermost movement to drive the folded portion of the sheet onto said second paper restraining means.

3. Apparatus for folding a sheet of paper as defined in claim 1 wherein:

a plurality of said folding mechanisms and said first and second paper restraining means are arranged to sequentially form multiple folds in said sheet of paper as it moves across said table.

4. Apparatus for folding a sheet of paper as defined in claim 1 wherein:

means are provided on said pulleys to permit the flexible member to be driven about said pulleys by said sheet ejecting means.

5. Apparatus for folding a sheet of paper as defined in claim 3 wherein:

said means on each pulley comprises a ring surrounding the periphery of the pulley, a plurality of roller bearings positioned between the peripheral surface of the pulley and the inner surface of the ring, and the outer surface of the ring having a flexible loop receiving surface.

6. Apparatus for folding a sheet of paper as defined in claim 1 wherein:

said sheet ejecting means comprises a plurality of rollers each of which has its outer periphery formed into outwardly extending legs.

7. Apparatus for folding a sheet of paper as defined in claim 1 wherein:

said means for moving said sheet of paper across said table surface includes two closely spaced driven endless belts, one on either side of said sheet, each of which includes spaced magnets attached to said belts, the facing said magnets of said belts clampingly engaged with one another and carrying each said sheet tightly clamped therebetween.

* * * * *